US006767257B2

(12) United States Patent
Arnett et al.

(10) Patent No.: US 6,767,257 B2
(45) Date of Patent: Jul. 27, 2004

(54) COMMUNICATION JACK THAT WITHSTANDS INSERTION OF A COMMUNICATION PLUG THAT THE JACK IS NOT SPECIFICALLY CONFIGURED TO MATE WITH WITHOUT BEING DAMAGE

(75) Inventors: Jaime Ray Arnett, Fishers, IN (US); Robert Ray Goodrich, Indianapolis, IN (US); Ronald L. Wild, Plano, TX (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 10/287,141

(22) Filed: Nov. 4, 2002

(65) Prior Publication Data

US 2003/0129880 A1 Jul. 10, 2003

Related U.S. Application Data

(60) Provisional application No. 60/346,223, filed on Jan. 4, 2002.

(51) Int. Cl.[7] ..... H01R 24/00
(52) U.S. Cl. ..... 439/676
(58) Field of Search ..... 439/676, 660, 439/941, 76.1, 344, 345, 418

(56) References Cited

U.S. PATENT DOCUMENTS 6,116,964 A * 9/2000 Goodrich et al. ..... 439/676

* cited by examiner

*Primary Examiner*—Son V. Nguyen
(74) *Attorney, Agent, or Firm*—Thomas, Kayden, Horstemeyer & Risley, LLP

(57) ABSTRACT

A communication jack that withstands insertion of a communication plug with which the jack is not configured to mate without being damaged. The communication jack comprises a wire board and a number of contact wires that extend above the wire board and that are electrically coupled to respective contact regions on the wire board at first ends of the contact wires. The contact wires having second ends that are freely disposed for making electrical connections with corresponding contact wires of a mating communication plug. Each of the freely disposed ends of the contact wires are cantilevered from respective fist ends of the contact wires such that the contact wires are capable of being deflected when the freely disposed ends wipe against respective contact wires of the mating communication plug. Some of the freely disposed ends are deflected to a lesser degree than at least two opposing, outer freely disposed ends when the freely disposed ends wipe against and are deflected by respective contact wires of a mating communication plug. The freely disposed ends that are deflected to a lesser degree than the opposing, outer freely disposed ends abut a surface of the wire board. The configuration of the wire board is such that the opposing, outer freely disposed ends avoid abutting the surface of the wire board when the freely disposed ends wipe against and are deflected by respective contact wires of a mating communication plug.

3 Claims, 4 Drawing Sheets

COMMUNICATION JACK THAT WITHSTANDS INSERTION OF A COMMUNICATION PLUG THAT THE JACK IS NOT SPECIFICALLY CONFIGURED TO MATE WITH WITHOUT BEING DAMAGE

CROSS-REFERENCE TO RELATED APPLICATION

This application claims priority to copending U.S. provisional application entitled, "High Performance RJ45 Data Jack That Withstands Insertion of RJ11 Telephone Plug," having ser. No. 60/346,223, filed Jan. 4, 2002, which is entirely incorporated herein by reference.

TECHNICAL FIELD OF THE INVENTION

The present invention generally relates to communication connector assemblies. More particularly, the present invention relates to a data jack, such as a RJ-45 data jack, that is configured to prevent it from being damaged by insertion of a communication plug that the jack is not specifically configured to work with, such as an RJ-11 telephone plug.

BACKGROUND OF THE INVENTION

Registered Jack-11 (RJ-11) is a wiring standard that describes wiring specifications for a four-or six-wire connector that is used primarily to connect telephone equipment in the United States. Telephones and facsimile machines are sometimes connected using local area network (LAN) wiring and jacks because an RJ-11 6-wire telephone-type plug will fit into the 8-wire RJ-45 wall jack and a telephone line can be connected to that circuit in the telecommunications closet. Registered Jack-45 (RJ-45) is a wiring standard that describes wiring specifications for an eight-wire connector that is commonly used to connect computers to a local-area networks (LAN), particularly Ethernet networks.

FIGS. 1A and 1B illustrate perspective and top views, respectively, of the jack 2 and plug 3 of an RJ-11 connector assembly. FIGS. 2A and 2B illustrate perspective and top views, respectively, of the jack 4 and plug 5 of an RJ-45 connector assembly. As is evident from FIGS. 1A–2B, RJ-45 connector assemblies look very similar to RJ-11 connector assemblies, except they are somewhat wider than RJ-11 connector assemblies. The jack 2 and plug 3 of the RJ-11 connector assembly have three respective pairs of contact wires, which define three different signal paths. The jack 4 and plug 5 of the RJ-45 connector assembly each have four respective pairs of contact wires, which define four different signal paths.

Due to the visual similarities between the RJ-11 and RJ-45 connector assemblies, and due to the fact that the associated jacks are often located near each other in buildings, people sometimes accidentally insert RJ-11 plugs into RJ-45 jacks. Because the RJ-11 plug is narrower than the RJ-45 plug, the RJ-11 plug can be inserted into the RJ-45 jack. Also, although the RJ-45 jack is not intended to work with an RJ-11 plug, it is possible to wire an RJ-45 jack to work with an RJ-11 plug. Regardless of whether insertion is accidental or intentional, when an RJ-11 plug is inserted into an RJ-45 jack, the RJ-45 jack can be damaged. Specifically, the RJ-11 plug has raised plastic surfaces (FIGS. 1B, 7 and 8) on both sides of the contacts, and when it is inserted into an RJ-45 data jack, the raised plastic surfaces 7 and 8 press against contact wires 1 and 8 and cause them to be deflected beyond their normal limit of deflection when an RJ-45 plug is inserted into the RJ-45 jack. As a result, the contacts become permanently set in this over-deflected position at times. Then, when an RJ-45 plug is coupled to the RJ-45 jack, the contact force needed to keep the contacts of the RJ-45 plug in abutment with the respective contacts of the RJ-45 jack is no longer present or is insufficient, which may result in poor performance.

Accordingly, a need exists for an RJ-45 jack that can withstand insertion of an RJ-11 plug and avoid damage to the RJ-45 jack.

SUMMARY OF THE INVENTION

In accordance with the present invention, a communication jack is provided that withstands insertion of a communication plug with which the jack is not configured to mate without being damaged. The communication jack comprises a wire board and a number of contact wires that extend above a surface of the wire board and that are electrically coupled to respective contact regions on the wire board at first ends of the contact wires. The contact wires have second ends that are freely disposed for making electrical connections with corresponding contact wires of a mating communication plug. Each of the freely disposed ends of the contact wires are cantilevered from respective first ends of the contact wires such that the contact wires are capable of being deflected toward a particular surface of the wire board when the freely disposed ends wipe against respective contact wires of the mating communication plug.

Some of the freely disposed ends are deflected toward a certain surface of the wire board to a, lesser degree than at least two opposing, outer freely disposed ends when the freely disposed ends wipe against and are deflected by respective contact wires of a mating communication plug. The freely disposed ends that are deflected to a lesser degree than the opposing, outer freely disposed ends abut the particular surface of the wire board and thus are constrained from further deflection. The configuration of the wire board is such that the opposing, outer freely disposed ends avoid abutting the particular surface of the wire board when the freely disposed ends wipe against and are deflected by respective contact wires of a mating communication plug.

In accordance with the preferred embodiment of the present invention, the configuration of the wire board includes two openings formed in the front edge region of the wire board below the opposing, outer freely-disposed ends. The openings allow the opposing, outer freely disposed ends of the contact wires (contact wires 1 and 8) of the jack to be deflected below the particular surface of the wire board when the freely disposed ends wipe against and are deflected by respective contact wires of a mating communication plug. Thus, the opposing, outer freely disposed ends of the contact wires do not come into contact with respective conductive pads on the wire board until the are deflected below the particular surface of the wire board.

The present invention also provides a method for preventing a communication jack from being damaged when it is mated with a communication plug with which the jack is not configured to mate. The method comprises the step of configuring a front edge region of the wire board of the communication jack so that freely disposed ends of at least two opposing, outer contact wires of the jack avoid abutment with a particular surface of the wire board when the freely disposed ends wipe against respective contact wires of a mating communication plug. When the freely disposed ends wipe against and are deflected by respective contact wires of the mating communication plug, all of the freely disposed ends other than the opposing, outer freely disposed ends abut the particular surface of the wire board. The opposing, outer freely disposed ends are deflected through openings formed in the wire board, thereby avoiding abutment with the particular surface of the wire board. Thus, damage to the opposing, outer freely disposed ends is avoided.

These and other features and advantages of the present invention will become apparent from the following description, drawings and claims.

DETAILED DESCRIPTION OF THE PREFERRED EMBODIMENT

Figure 1A:
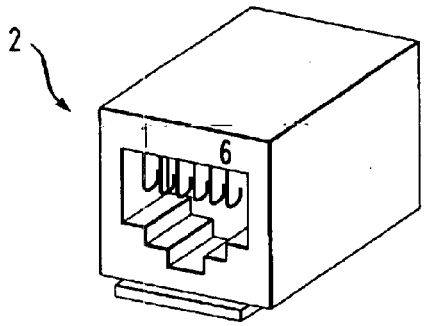
FIGS. 1A and 1B illustrate perspective and top views, respectively, of the jack and plug of an RJ-11 connector assembly.
Figure 1B:
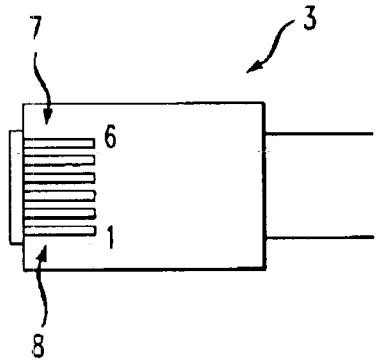
Figure 2A:
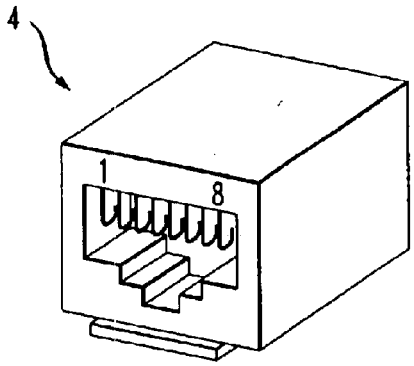
FIGS. 2A and 2B illustrate perspective and top views, respectively, of the jack and plug of an RJ-45 connector assembly.

With reference again to FIGS. 1A–2A, when the RJ-11 plug shown in FIG. 1B is inserted into the RJ-45 jack shown in FIG. 2A, the top side portions 7 and 8 of the molded plastic housing of the plug 3, which are slightly raised in comparison to the height of the contacts 1–6 of plug 3, press up on contacts 1 and 8, respectively, of jack 4 and deflect contacts 1 and 8 of jack 4 beyond their normal deflected positions (i.e., beyond their deflected positions when the RJ-45 plug 5 is inserted into the RJ-45 jack 4). The contacts 1–6 of the RJ-11 plug 3 make normal contact with contacts 1–6, respectively, of the RJ-45 jack 4. As indicated above, contacts 1 and 8 of the RJ-45 jack 4 may remain permanently bent as a result of this abnormal deflection after the RJ-11 plug 3 has been removed.

Figure 3:
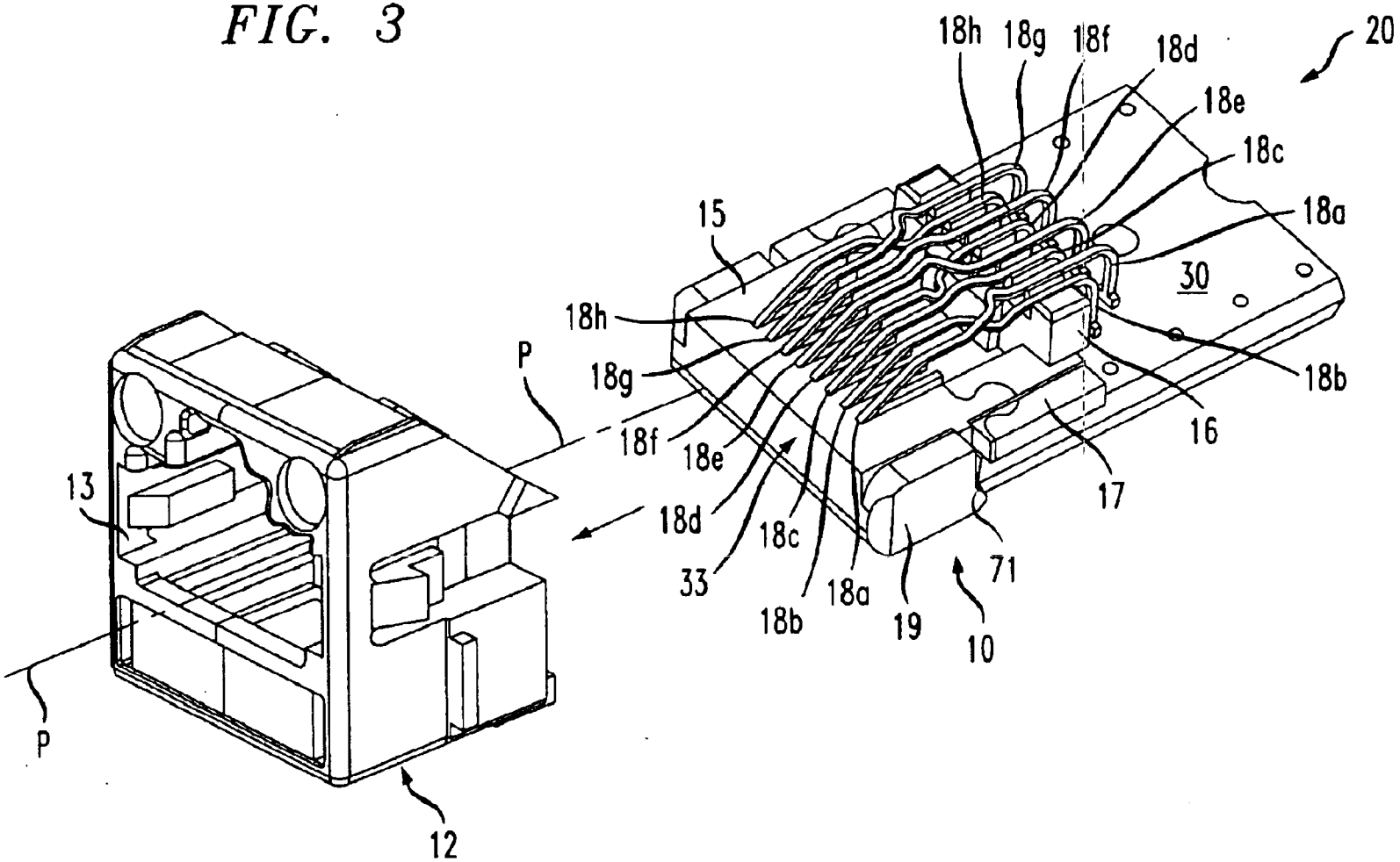
FIG. 3 is a perspective view of a known jack that meets the RJ-45 requirements.

FIG. 3 is a perspective view of a known jack that meets the RJ-45 requirements and will be referred to hereinafter as the "RJ-45 jack". This communication jack is disclosed in U.S. Pat. No. 6,186,834, which is incorporated by reference herein in its entirety. This jack is an example of the type of jack with which the present invention may be implemented. This jack will be described herein to demonstrate an example of the manner in which the present invention may be implemented. However, those skilled in the art will understand, in view of the discussion provided herein, that the present invention is not limited to use with any particular jack.

Figure 2B:
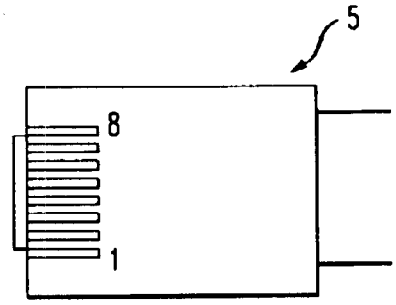

The RJ-45 jack 20 comprises a frame or housing 12 configured to receive a wiring assembly 10, which is then mounted to the housing 12. The housing 12 has a front face in which a plug opening 13 is formed for receiving an RJ-45 plug 5 (FIG. 2B). To couple the plug 5 with the jack 20, the plug 5 is inserted into the plug opening 13 along axis P and latches into a coupling position at which it is electrically connected with the wiring assembly 10. The wiring assembly 10 has an associated, generally rectangular printed wire board (PWB) 30. The wire board 30 may comprise, for example, a single or a multi-layer dielectric substrate. Eight elongated terminal contact wires 18*a*–18*h* emerge from a central portion of the printed wire board 30. The contact wires 18*a*–18*h* extend substantially parallel to one another, and are generally uniformly spaced from a top surface 15 of a two-part contact wire guide structure 16. A first support part 17 of the guide structure 16 is fixed on a front portion of the wire board 30.

A second support part 19 is fixed to a front end of the first support part 17, and projects in a forward direction from the wire board 30. The second support part 19 of the guide structure has a number of parallel channels opening in the top surface 15 thereof for pre-loading and for guiding the free end portions (not shown) of corresponding contact wires 18*a*–18*h*. Contact wires 18*a*–18*h* of the jack 20 correspond to contact wires 8-1, respectively, of the plug 5 shown in FIG. 2B.

The contact wires 18*a*–18*h* are formed and arranged to deflect resiliently toward the top surface 15 of the guide structure 16 when free end portions (not shown) of contact wires 18*a*–18*h* are engaged by the wire contacts 8-1, respectively, of a mating RJ-45 plug 5. The material forming the contact wires 18*a*–18*h* may be, for example, a copper alloy, such as, spring-tempered phosphor bronze, beryllium copper, or the like.

The wire board 30 may incorporate conductive traces, electrical circuit components or other devices, such as devices designed to compensate for connector-induced crosstalk. The terminal contact wires 18*a*–18*h* have upstanding base portions that are electrically connected to conductors associated with the wire board 30 at the end of the wire board 30 opposite the housing 12. The wire board 30 has a wire connection terminal region at which outside, insulated wire leads (not shown) are connected to an array of contact terminals (not shown) located in the terminal region. Such terminals may be so-called insulation displacing connector (IDC) terminals having respective leg parts connected to respective conductive traces on the board 30, each trace being associated with one of the terminal contact wires 18*a*–18*h*. The wire connection terminal region may be enclosed by a terminal housing (not shown) on the top side of the board 30, and a cover (not shown) on the bottom side of the board 30.

The free end portions of contact wires 18*a*–18*h* are disposed beneath the surface 15 of the wire board 30 and are supported in cantilevered fashion by the connections between the contact wires 18*a*–18*h* and the wire board 30 at the ends of the contact wires 18*a*–18*h* opposite the face 13 of the housing 12. The free end portions of the contact wires 18*a*–18*h* are deflected by pins 8-1 of the plug 5 (FIG. 2B), respectively, and make electrical contact with electrical contacts (not shown) on the wiring board 30 when the plug 5 (FIG. 2B) is inserted into the opening 13 in the housing 12. The manner in which this occurs will now be described with reference to FIG. 4.

Figure 4:
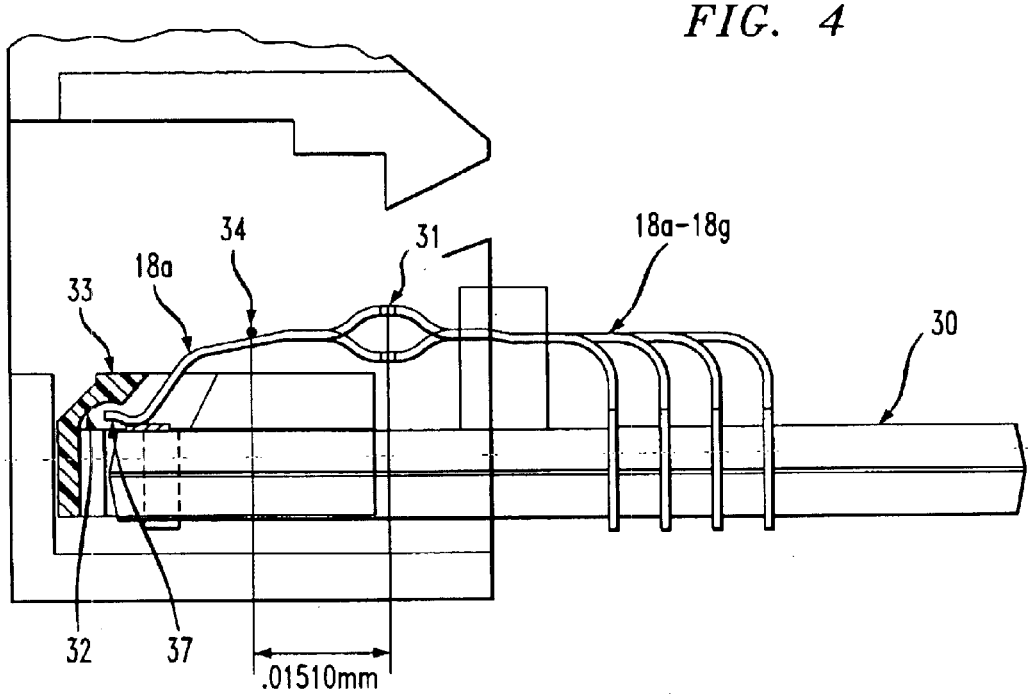
FIG. 4 is a side view of the wire board of the RJ-45 jack shown in FIG. 3 that illustrates the free ends of the contact wires 1 and 8 when they are in their deflected positions and in electrical contact with respective contact pads on the wiring board.

FIG. 4 is a side view of a portion of the jack 20 shown in FIG. 3 that illustrates the free ends of the contact wires 18*a* and 18*h* when they are in their deflected positions and in electrical contact with respective contact pads on the wire board 30. Only the free end of contact wire 18*a* can be seen in FIG. 4 at location 37. Certain pairs of the terminal contact wires cross over at location 31. The manner in which the contact wires 18*a*–18*h* cross over can also be seen from the top perspective view of FIG. 3. As seen in FIG. 2, the terminal contact wires 18*a*–18*h* curve arcuately. When in the undeflected position, the free ends of the terminal contact wires 18*a*–18*h* abut an upper inside surface 32 of the guideway 33. A predetermined pre-load force is thus established, which is applied against the wire contacts of the plug 4 (FIG. 2B) when the wire contacts of the plug 5 wipe against the free ends 37 of the contact wires 18*a*–18*h* at position 34 and urge them downward into the deflected position 37 shown in FIG. 4 at which the free end is immediately adjacent the surface 15 of the wire board 30.

The deflected position shown in FIG. 4 is the normal deflected position when an RJ-45 plug is inserted into the RJ-45 jack 20. However, as stated above, when an RJ-11 plug (FIG. 1B) is inserted into RJ-45 jack 20, the raised plastic on the RJ-11 housing deflects contact wires 18*a* and 18*h* more than they are supposed to be deflected, which may result in permanent damage to contact wires 18*a* and 18*h*. In accordance with the present invention, the wire board 30 is configured to allow more deflection of the contact wires 18*a* and 18*h* so that the contact wires 18*a* and 18*h* will not be bent out of shape when an RJ-11 plug is inserted into the jack 20. However, the configuration is also such that when an RJ-45 plug is inserted into the RJ-45 jack 20, the contact wires 18*a* and 18*h* are deflected to the proper position 37 shown in FIG. 4.

Figure 5:
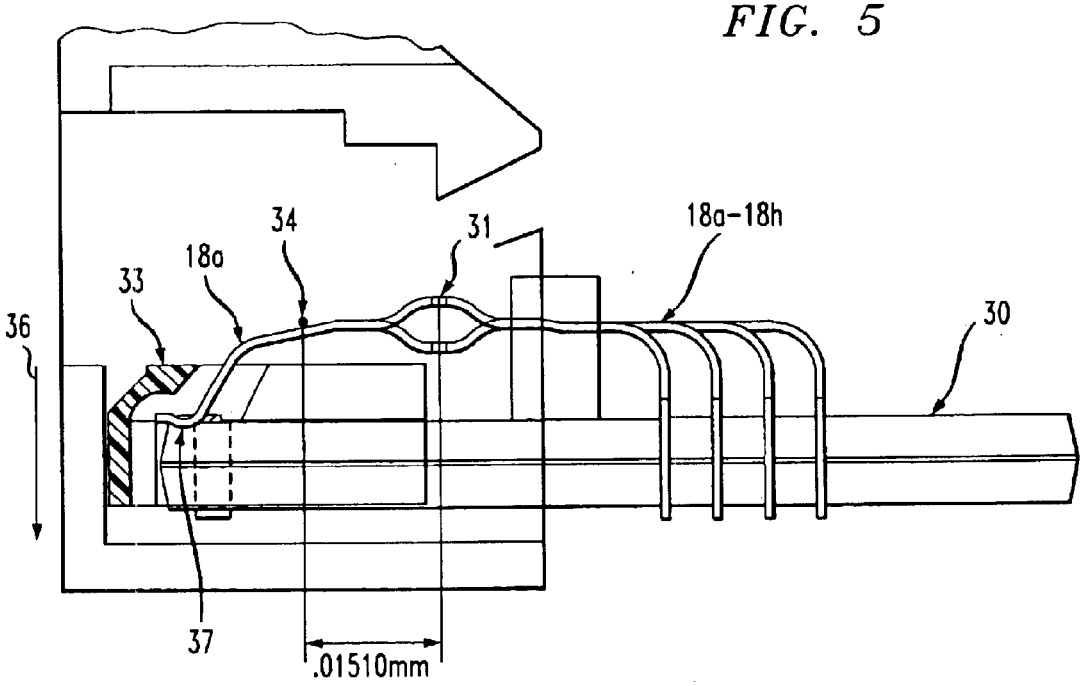
FIG. 5 is a side view of the wiring board of the RJ-45 jack in accordance with the present invention that illustrates the deflected positions of contact wires 1 and 8 when an RJ-11 plug is inserted into the RJ-45 jack.

FIG. 5 is a side view of a portion of the RJ-45 jack 20 that illustrates the deflected positions of contact wires 18*a* and 18*h* when an RJ-11 plug is inserted into the jack 20. In accordance with the preferred embodiment of the present invention, a portion of the wire board 30 has been removed at the locations 37 on each side of the wire board 30 where the contact wires 18*a* and 18*h* would normally abut when an RJ-45 plug is inserted into the jack 20. By removing portions of the wire board 30 at these locations, the contact wires 18*a* and 18*h* are allowed to travel farther in the direction indicated by arrow 36 before they come into contact with respective contact pads on the wire board 30 when an RJ-11 plug is inserted into the jack 20. This prevents the contact wires 18*a* and 18*h* from being damaged.

Figure 6:
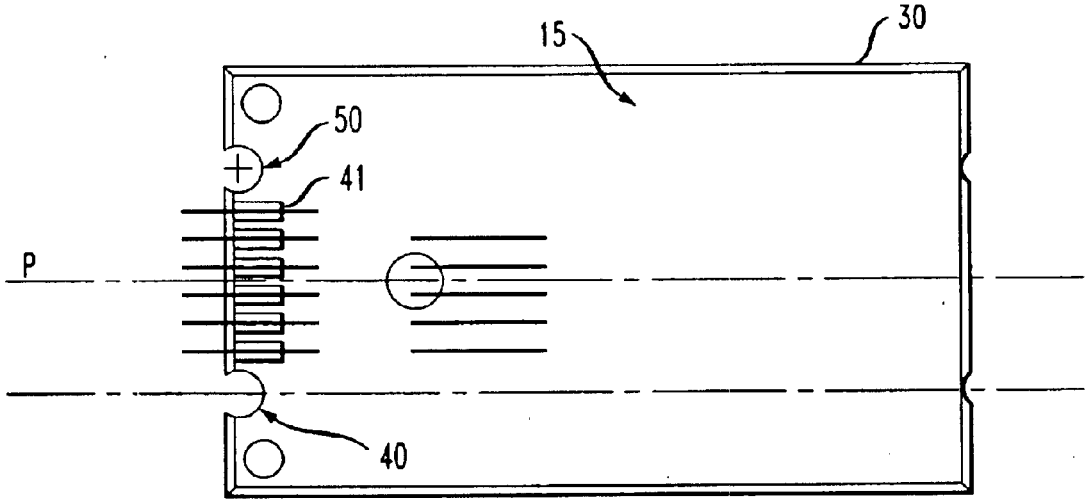
FIG. 6 is a top view of the wiring board of the present invention in accordance with the preferred embodiment wherein portions of the wire board have been removed to allow increased travel of contact wires 1 and 8.

As seen in FIG. 5, the free end 37 of contact wire 18*a* is deflected below the surface 15 of the wire board 30. This is also the case with the free end of contact wire 18*h*, but only contact wire 18*a* can be seen in the view provided by FIG. 5. FIG. 6 is a top view of the wire board 30 of the present invention in accordance with the preferred embodiment wherein portions 40 and 50 have been removed therefrom to allow increased travel of the free ends of contact wires 18*a* and 18*h*, respectively. FIG. 6 also illustrates the contact pads 41 on the surface 15 of the wire board 30, which contact wires 18*b*–1*g* abut when a plug is inserted into the jack 20. At the locations at which the contact pads 41 would normally be for connecting with contact wires 18*a* and 18*h*, openings 40 and 50 have been formed in the wire board 30. Therefore, when contact wires 18*a* and 18*h* are deflected, they will move a distance through these openings such that they are deflected beyond their normal deflected positions before they come into contact with respective contact pads (not shown) on the wire board 30. Because the contact wires 18*a* and 18*h* move through these openings 40 and 50 instead of impinging on the surface 15 of the wire board 30, over-deflection of the contact wires 18*a* and 18*h* is prevented, and damage to contact wires 18*a* and 18*h* is avoided.

Although the openings are shown as being breakout holes 40 and 50 at the front edge of the wire board 30 where contacts 18*a* and 18*h* would normally touch the board when deflected, this is merely one of many possible configurations for achieving the goals of the present invention. For example, rather than forming breakout holes 40 and 50 in the wire board 30, indentations could be formed in the wire board 30 that would serve the same purpose. Those skilled in the art will understand, in view of the discussion provided herein, that a variety of configurations are suitable for this purpose. Essentially, the present invention provides for increased travel of the contact wires 18*a* and 18*h* in order to avoid bending of contact wires 18*a* and 18*h*. The scope of the present invention covers any and all techniques and/or mechanisms for achieving this goal.

It should also be noted that the present invention is not limited to being implemented only in connection with an RJ-45 communication jack to prevent damage thereto when an RJ-11 communication plug is inserted into the jack. The present invention applies equally to other types of jacks that may be susceptible to damage caused by insertion of a plug with which the jack is not configured to mate.

It should be noted that the present invention has been described with reference to the preferred embodiments and that it is not limited to these embodiments. Modifications, additions and/or deletions can be made to the embodiments described herein without deviating from the spirit and scope of the present invention. Those skilled in the art will understand in view of the discussion provided herein that all such modifications, deletions and additions are within the scope of the present invention.

What is claimed is:

1. A communication jack comprising:

a wire board having a front edge region; and a number of contact wires extending above the wire board and electrically coupled to respective contact regions on the wire board at first ends of the contact wires, the contact wires having second ends that are freely disposed for making electrical connections with respective contact wires of a first mating communication plug, each of the second ends of the contact wires being cantilevered from respective first ends of the contact wires such that the contact wires are capable of being deflected toward a surface of the wire board when the second ends wipe against the respective contact wires of the first mating communication plug, and wherein the wire board is configured such that all inner ends of the second ends are deflected to a lesser degree than two opposing, outer freely disposed ends of the second ends when the second ends wipe against and are deflected toward said surface of the wire board by respective contact wires of a second mating communication plug, and wherein all inner ends of the second ends that are deflected to a lesser degree than said two opposing, outer freely disposed ends end abut said surface of the wire board, and wherein the configuration of the wire board is such that said at least two opposing, outer freely disposed ends avoid abutting said surface of the wire board when all the inner ends of the second ends wipe against and are deflected by the respective contact wires of the second mating communication plug;

wherein the configuration of the wire board includes at least two openings formed in the front edge region of the wire board below said two opposing, outer freely disposed ends, said openings preventing said two opposing, outer freely disposed ends from abutting said surface of the wire board when all the inner ends of the second ends wipe against and are deflected by the respective contact wires of the second mating communication plug.

2. The communication jack of claim 1, wherein the communication jack is an RJ-45 communication jack, the first communication plug is an RJ-45 communication plug, and the second communication plug is an RJ-11 communication plug.

3. The communication jack of claim 2, wherein when the RJ-45 communication jack is coupled to the RJ-45 communication plug, all of the second ends wipe against and are deflected to approximately the same degree by the respective contact wires of the RJ-45 communication plug, and wherein when the RJ-45 communication jack is mated with the RJ-11 communication plug, all of the inner ends of the second ends are deflected to a lesser degree than the two opposing, outer freely disposed ends when all the inner ends of the second ends wipe against and are deflected by the respective contact wires of the RJ-11 communication plug.

* * * * *